US005406910A

United States Patent [19]

Wallin

[11] Patent Number: 5,406,910

[45] Date of Patent: Apr. 18, 1995

[54] COMBINATION OIL COOLER AND OIL FILTER ASSEMBLY FOR INTERNAL COMBUSTION ENGINE

[75] Inventor: Charles M. Wallin, Livonia, Mich.

[73] Assignee: Ford Motor Company, Dearborn, Mich.

[21] Appl. No.: 155,495

[22] Filed: Nov. 22, 1993

[51] Int. Cl.[6] ..... F28F 3/00

[52] U.S. Cl. ..... 123/41.33; 165/51; 165/916; 210/186

[58] Field of Search ..... 165/51, 916; 123/41.33

[56] References Cited

U.S. PATENT DOCUMENTS 3,743,011 7/1973 Frost ..... 165/916 X 4,892,136 1/1990 Ichihara et al. ..... 123/41.33 X

*Primary Examiner*—John C. Fox

*Attorney, Agent, or Firm*—Jerome R. Drouillard; Roger L. May

[57] ABSTRACT

A combination oil filter and oil cooler assembly for an internal combustion engine includes a housing mounted to one side of the engine's cylinder block and having provisions for conducting engine coolant and engine oil to and from the engine block to heat exchanger and filter elements incorporated in the assembly. A generally cylindrical heat exchanger mounted within the housing receives the engine coolant and oil and transfers heat from the oil to the coolant. An oil filter mounted to one end of the heat exchanger filters oil before the oil passes through the heat exchanger and into the engine block.

2 Claims, 3 Drawing Sheets

COMBINATION OIL COOLER AND OIL FILTER ASSEMBLY FOR INTERNAL COMBUSTION ENGINE

BACKGROUND OF THE INVENTION

This invention relates to a compact, single-housing assembly including an oil filter and an oil cooler for obtaining heat exchange between the coolant of an engine and the lubricating oil circulating through the engine.

DESCRIPTION OF THE PRIOR ART

Certain automotive internal combustion engines, notably high performance engines, have high heat rejection rates which cannot always be accommodated merely by decreasing the temperature of the engine coolant by passing the coolant through an air-to-liquid heat exchanger commonly termed "a radiator" in automotive parlance. Thus, in certain instances, it is necessary to directly chill the engine's lubricating oil. This is sometimes accomplished by passing the oil through an air-to-oil heat exchanger which is mounted in the air stream flowing past the vehicle. Another technique calls for mounting a heat exchanger within the radiator of the vehicle so that coolant flowing through the radiator will chill the oil passing through the heat exchanger. Unfortunately, both of these approaches require the use of external hoses to conduct the oil to and from the engine. This is disadvantageous because such hoses increase the expense of the system as well as causing problems because of the fact that their mere presence requires additional space and packaging considerations within the engine compartment of the vehicle. It is also known to provide oil chilling, or oil cooling, by means of an oil cooler mounted remotely from the engine block of the vehicle and having hoses extending to and from the cooling system of the engine. This type of system suffers from a similar drawback insofar as the coolant hoses are subject to failure, with often catastrophic results if the driver of the vehicle does not stop the engine almost immediately upon loss of coolant. Certain engines, such as those constructed by Detroit Diesel, have used an oil cooler assembly mounted to the side of the engine block. These oil coolers are long, substantially rectangular devices having a large adapter bolted to the engine block with the oil filer located adjacent the oil cooler. This type of design is unfortunately not compact enough for passenger car internal combustion engines.

It is a feature and an advantage of the present invention that the previous problems associated with engine oil coolers are solved because the present combination in oil cooler and filter assembly requires no added external water or oil lines or hoses, and of equal importance, its compact design allows the oil filter cartridge or spin-on filter to be mounted directly to the heat exchanger, thereby avoiding unnecessary coolant and oil side pressure drops, in a compact unit suitable for use with today's crowded automotive engine compartments.

SUMMARY OF THE INVENTION

A combination oil filter and oil cooler assembly for an internal combustion engine having a cylinder block and a coolant radiator includes a housing mounted to one side of the cylinder block and having provisions integral with the housing for conducting engine coolant from the radiator into the cylinder block, as well as engine oil to and from the cylinder block. A generally cylindrical heat exchanger cartridge is mounted within a cylindrical bore situated within a cylinder block-mounted housing, with the heat exchanger receiving coolant and oil flowing through the combination assembly such that heat is transferred from the oil to the coolant as the oil and coolant flow through the combination assembly. The heat exchanger cartridge has a first end for receiving oil from the oil filter and a second end having a port for discharging cooled oil. The generally cylindrical surface extending between the ends has passages for allowing engine coolant to pass through the cooler into the engine block. The coolant is introduced into and exits from the bore in a generally tangential flow. An oil filter mounted coaxially upon the first end of the heat exchanger filters the oil and passes the oil to the oil cooler where it is chilled before being returned to the cylinder block.

DETAILED DESCRIPTION OF THE PREFERRED EMBODIMENTS

Figure 1:
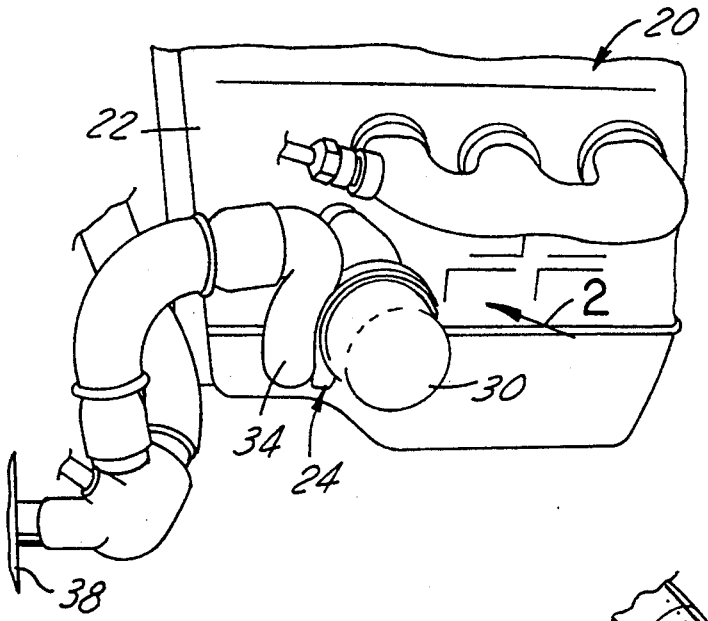
FIG. 1 is a representation of an engine having a combination oil filter and oil cooler assembly according to the present invention.
Figure 2:
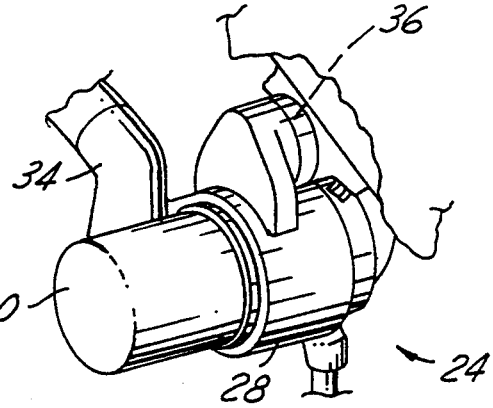
FIG. 2 is a perspective view of a filter and cooler assembly according to the present invention taken in the direction of arrow 2 of FIG. 1.

As shown in FIG. 1, an engine 20 having a cylinder block 22 is equipped with an oil cooler and filter assembly 24 according to the present invention. Coolant discharged by radiator 38 flows through a series of hoses and into water inlet 34. The coolant is conducted through combination oil filter and oil cooler assembly 24 so that heat contained within the oil will be transferred from the oil to the coolant. Heat contained within the oil will be transferred to the coolant and then the heat will be removed from the engine when the coolant passes through the radiator and the heat within the coolant is transferred to the ambient air. As shown in FIG. 2, an oil filter 30 of the spin-on type is attached to what will be described as the oil cooler portion of combination oil filter and oil cooler 24.

Figure 3:
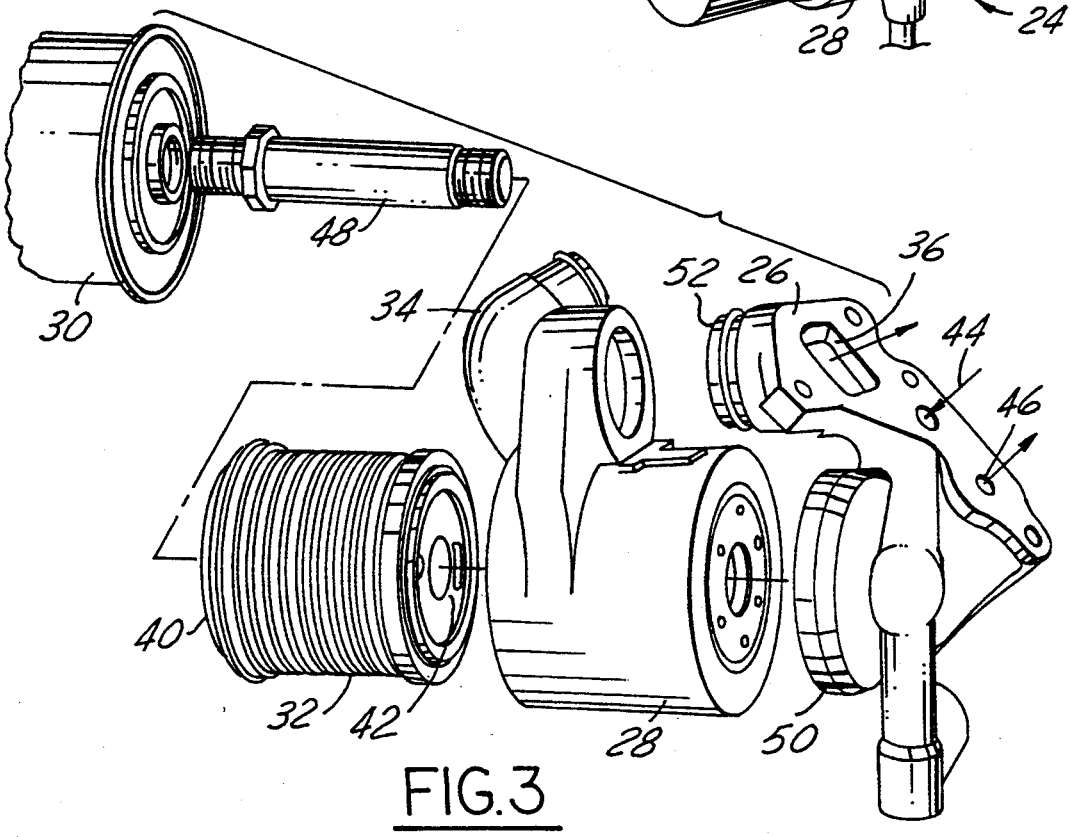
FIG. 3 is an exploded perspective view of a combination oil filter and oil cooler assembly according to the present invention.

FIG. 3 shows additional details of an assembly according to the present invention. Base portion 26 is bolted directly to engine cylinder block 22. Water entering combination assembly 24 through water inlet 34 is discharged to cylinder block 22 through water outlet 36. Lubricating oil enters combination assembly 24 through oil input port 44. Oil which has been cooled leaves combination assembly 24 and reenters engine block 22 through oil discharge port 46. Cooler portion 28 is attached to base portion 26 at two locations. The first location is a conventional oil filter boss, 50, which is shown with particularity in FIGS. 3, 6, and 7. Cooler portion 28 is also attached to base 26 by means of water passage connector 52, which allows water leaving cooler portion 28 to pass to water outlet 36.

Figure 6:
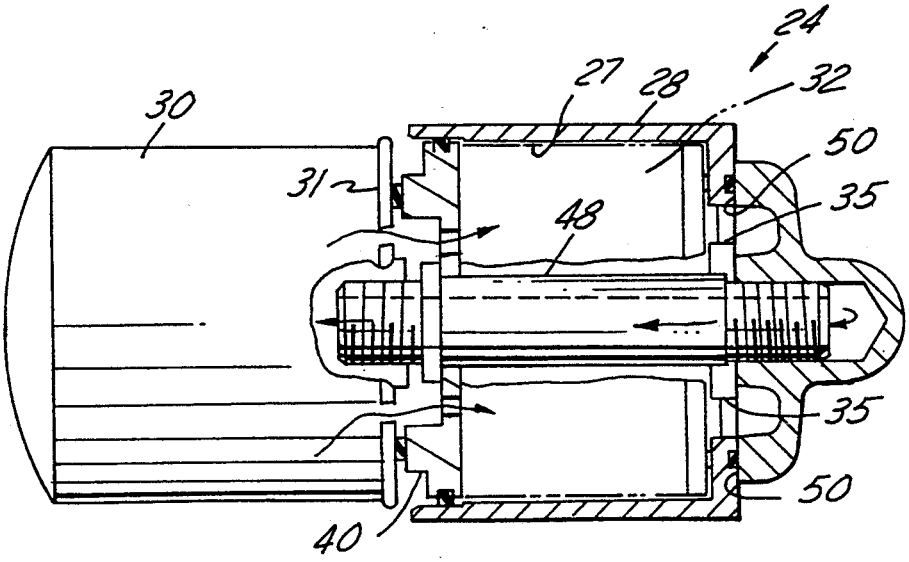
FIG. 6 is a longitudinal sectional view of a filter and cooler assembly according to the present invention.
Figure 8:
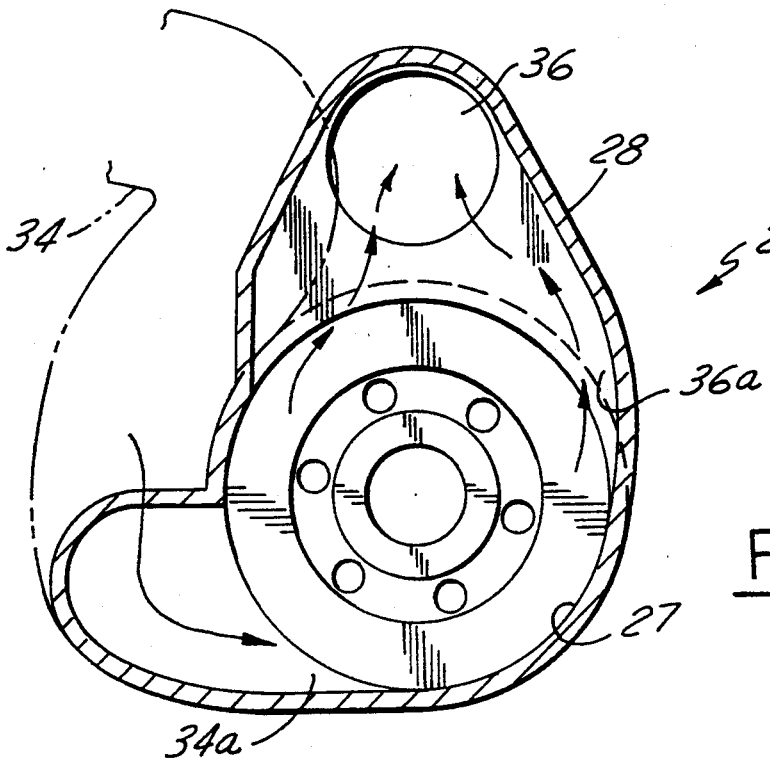
FIG. 8 is a sectional view of a filter and cooler assembly according to the present invention taken along the line 8—8 of FIG. 7.

As shown in FIGS. 3, 6, and 8, generally cylindrical heat exchanger cartridge 32 is mounted within cylindrical bore 27 located within cooler portion 28. The function of cylindrical heat exchanger cartridge 32 is to receive engine coolant and engine oil and to allow the interchange of heat from the oil to the coolant.

Heat exchanger cartridge 32 is maintained within bore 27 situated in cooler portion 28 by means of standpipe 48, which extends through the center of heat exchanger cartridge 32 (see FIGS. 3 and 6). Oil filter cartridge 30 is shown as comprising a spin-on canister, which is attached to first end 40 of heat exchanger 32 such that lubricating oil passes through filter 30 and directly into heat exchanger 32 before being returned to cylinder block 22. Because filter 30 is attached coaxially with heat exchanger 32, the present combination assembly is more compact than other types of oil filter and cooler arrangements, while obviating the need for external plumbing.

Figure 7:
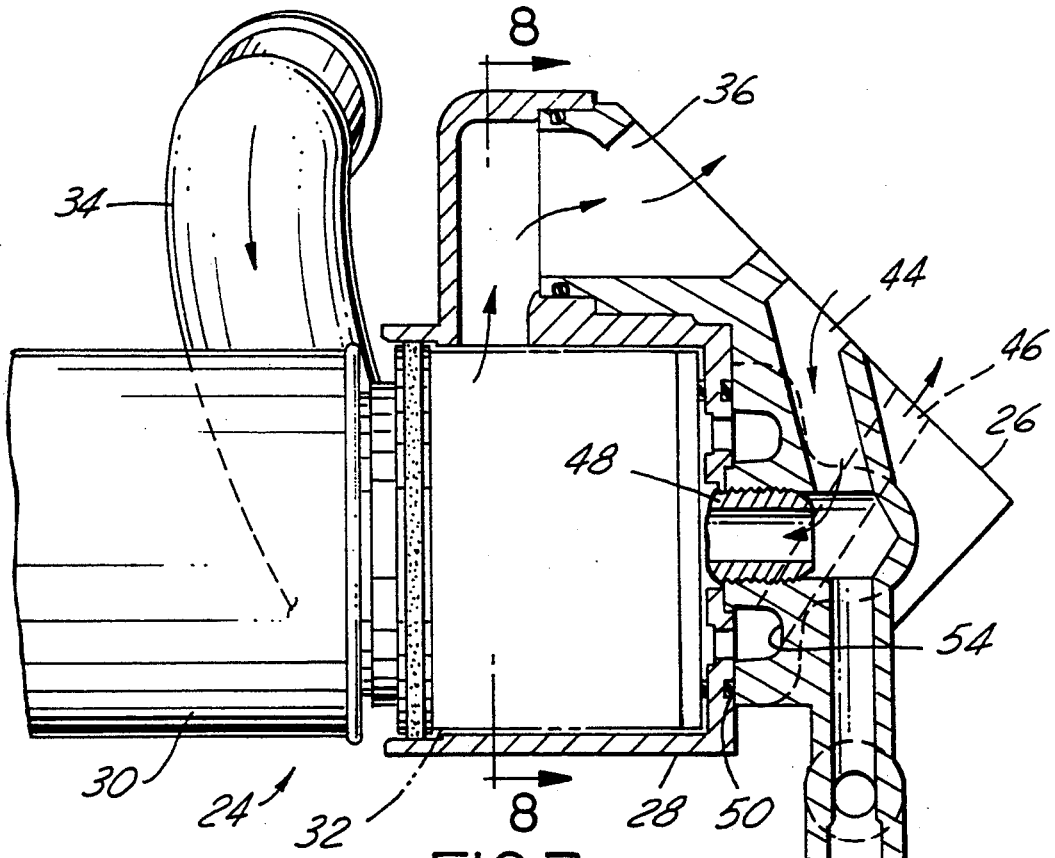
FIG. 7 is a sectional view of a filter and cooler assembly according to the present invention taken along the lines 7—7 of FIG. 4.

As shown in FIGS. 6 and 7, oil entering combined oil filter and oil cooler assembly 24 through input port 44 first passes through standpipe 48 and then up through standpipe 48 to filter 30. Then, as shown in FIG. 6, oil is discharged through a series of holes, 33, located in mating surface 31 of oil filter 30 and then the oil is allowed to flow into heat exchanger 32. After flowing through heat exchanger 32, the oil passes through a series of holes, 35, in the end of cooler portion 28 which is attached to base portion 26 and into annular collection groove 54 (FIG. 7) and then into discharge port 46. Note that all of the oil passing to and from the filter is allowed to pass through heat exchanger 32; none of the oil is allowed to bypass the heat exchanger. In a performance test of a combination assembly according to the present invention, a vehicle equipped with a 4.6 L eight cylinder engine was operated at high speed with a heat exchanger cartridge having a length and diameter of about 90 mm. Oil entered the combination assembly at 305° F. and exited at 277° F. This temperature drop was sufficient to avoid thermal breakdown of the lubricating oil, while increasing the temperature of the water or coolant flowing to the radiator by only 3° F.

Figure 4:
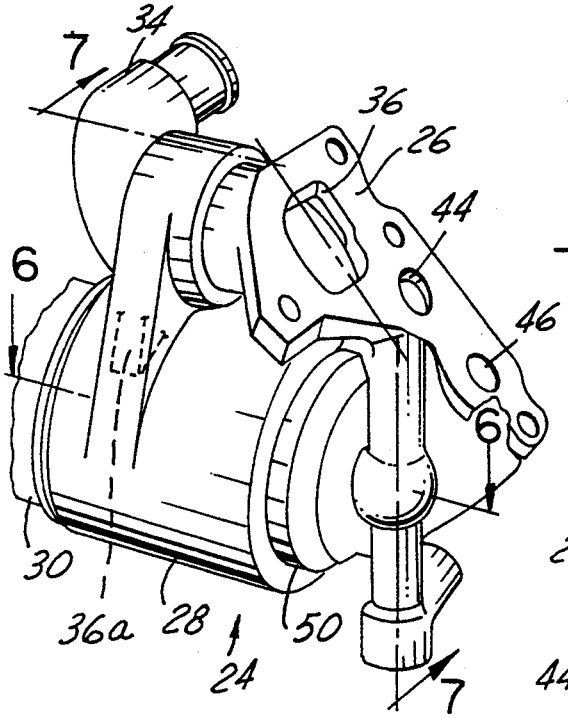
FIG. 4 is a perspective view of a filter and cooler assembly according to the present invention in its assembled state.
Figure 5:
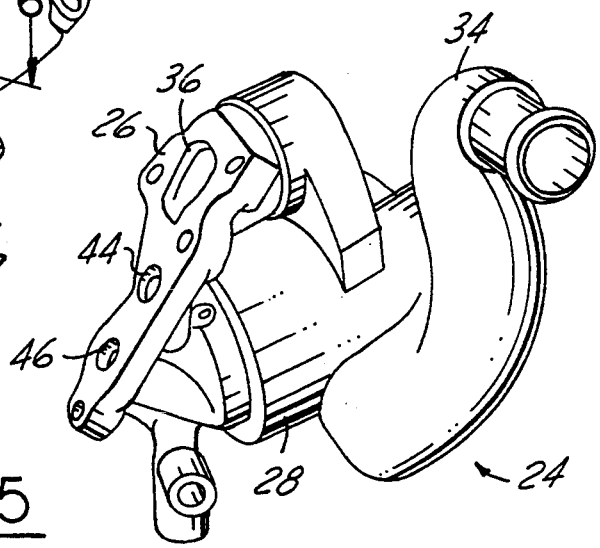
FIG. 5 is a perspective view of a filter and cooler assembly according to the present invention in its assembled state.

Flow of water or "coolant" through a combination assembly according to the present invention, is shown with particularity in FIG. 8. Water entering the combination assembly through water inlet 34 flows into heat exchanger cartridge 32 through space 34a in a tangential manner. This tangential flow allows the water to flow through heat exchanger 32 with minimal pressure drop. Similarly, water is discharged from the heat exchanger through space **36*a* (see FIG. 4**) in a tangential flow. This too allows water flow through the combination assembly without undue pressure drop. The water flows through a series of passages within the heat exchanger, so as to obtain a high level of heat transfer between the oil and coolant.

While the invention has been shown and described in its preferred embodiment, it will be clear to those skilled in the arts to which it pertains that many changes and modifications may be made thereto without departing from the scope of the invention. For example, the oil filter could be a cartridge type, instead of the illustrated spin-on type. Also, the precise flow paths for the oil and coolant through the combination assembly may be altered to accommodate the needs of any particular engine to which the present invention is applied.

I claim:

1. A combination oil filter and oil cooler assembly for an internal combustion engine having a cylinder block and a cooling radiator, with said combination assembly comprising:

a housing mounted to one side of said cylinder block and having provisions integral with said housing for conducting engine coolant from the radiator and into a single external water passage connector for receiving coolant from the radiator, with said connector comprising part of a base portion which is bolted to the cylinder block, with said base portion further comprising a water outlet which discharges coolant directly into the cylinder block without passing through an external hose, with said housing also having provisions for conducting engine oil to and from the cylinder block to heat exchanger and filter elements incorporated in said assembly, with said housing having a cylindrical bore situated within for containing a heat exchanger;

a generally cylindrical heat exchanger cartridge mounted within said bore, with said heat exchanger receiving said coolant and oil flowing through the combination assembly such that heat is transferred from said oil to said coolant as the oil and coolant flow through the combination assembly, with said heat exchanger cartridge having a first end for receiving oil from an oil filter, a second end having a port for discharging cooled oil, and a generally cylindrical surface, extending between said ends, with said generally cylindrical surface having passages for allowing engine coolant to pass through said cooler and into the engine block, with said coolant being introduced into and exiting from said bore in a generally tangential flow; and an oil filter mounted coaxially upon the first end of said heat exchanger such that lubricating oil passes through the filter and directly into the oil cooler before being returned to the cylinder block.

2. A combination oil filter and oil cooler assembly according to claim 1, wherein said filter comprises a spin on canister.

* * * * *